US009644404B2

(12) United States Patent
Strole et al.

(10) Patent No.: US 9,644,404 B2
(45) Date of Patent: May 9, 2017

(54) CINCHING STRIKER WITH ADJUSTMENT MECHANISM

(71) Applicant: STRATTEC Security Corporation, Milwaukee, WI (US)

(72) Inventors: Michael Strole, Royal Oak, MI (US); Sergio Vega, Ciudad Juarez (MX); Ian Martin, Waterford, MI (US)

(73) Assignee: STRATTEC SECURITY CORPORATION, Milwaukee, WI (US)

( * ) Notice: Subject to any disclaimer, the term of this patent is extended or adjusted under 35 U.S.C. 154(b) by 0 days.

(21) Appl. No.: 14/866,416

(22) Filed: Sep. 25, 2015

(65) Prior Publication Data

US 2016/0090762 A1 Mar. 31, 2016

Related U.S. Application Data

(60) Provisional application No. 62/055,400, filed on Sep. 25, 2014.

(51) Int. Cl.

| | |
|---|---|
| ***E05B 81/00*** | (2014.01) |
| ***E05B 81/20*** | (2014.01) |
| ***E05B 83/18*** | (2014.01) |
| ***E05B 85/04*** | (2014.01) |
| *E05B 81/44* | (2014.01) |
| *E05B 81/34* | (2014.01) |

(52) U.S. Cl.

CPC ..... *E05B 81/20* (2013.01); *E05B 83/18* (2013.01); *E05B 85/045* (2013.01); *E05B 81/34* (2013.01); *E05B 81/44* (2013.01)

(58) Field of Classification Search

CPC .... E05B 15/024; E05B 15/022; E05B 15/025; E05B 15/0275; E05B 47/0046; E05B 47/0047; E05B 63/244; E05B 81/22; E05B 85/04; Y10T 292/699; Y10T 292/696; Y10T 292/42; Y10T 292/60

USPC ..... 292/341.15, 341.16, 341.18; 296/76

See application file for complete search history.

(56) References Cited

U.S. PATENT DOCUMENTS

| | | | | | |
|---|---|---|---|---|---|
| 2,896,990 | A | * | 7/1959 | Garvey | E05B 81/22 292/201 |
| 3,047,326 | A | * | 7/1962 | Leslie | E05B 83/16 292/341.15 |
| 3,056,619 | A | * | 10/1962 | Fox | E05B 83/16 292/341.15 |

(Continued)

FOREIGN PATENT DOCUMENTS

| | | | |
|---|---|---|---|
| DE | 10004242 | * | 8/2000 |
| DE | 19910031 | * | 9/2000 |

(Continued)

*Primary Examiner* — Janet M Wilkens

(74) *Attorney, Agent, or Firm* — Michael Best & Friedrich LLP

(57) ABSTRACT

An adjustable cinching striker assembly for installation on a vehicle. The adjustable striker assembly includes a mounting frame for selectively mounting the adjustable striker assembly to the vehicle, and a striker moveably coupled to the mounting frame. A motor is coupled to the striker for moving the striker with respect to the mounting frame from an uncinched position to a cinched position, movement of the striker defining a cinching direction. The cinched position is adjustable with respect to the mounting frame.

16 Claims, 11 Drawing Sheets

(56) References Cited

U.S. PATENT DOCUMENTS

| | | | | | |
|---|---|---|---|---|---|
| 3,081,078 | A * | 3/1963 | Lohr | E05B 81/22 | 292/251 |
| 3,312,491 | A * | 4/1967 | Peters | E05B 47/0607 | 292/201 |
| 3,403,934 | A * | 10/1968 | Butts | E05B 81/22 | 292/144 |
| 4,746,153 | A * | 5/1988 | Compeau | E05B 81/22 | 292/216 |
| 4,796,932 | A * | 1/1989 | Tame | E05B 81/20 | 292/112 |
| RE33,758 | E * | 12/1991 | Compeau | E05B 81/22 | 292/216 |
| 5,429,400 | A * | 7/1995 | Kawaguchi | E05B 81/22 | 292/201 |
| 6,810,699 | B2 * | 11/2004 | Nagy | E05B 15/0086 | 292/341.15 |
| 9,004,570 | B1 * | 4/2015 | Krishnan | E05B 83/18 | 292/201 |
| 9,140,039 | B1 | 9/2015 | Krishnan et al. | | |
| 2005/0218670 | A1 * | 10/2005 | Brose | E05B 81/22 | 292/341.16 |
| 2006/0175846 | A1 * | 8/2006 | Rice | E05B 81/22 | 292/341.16 |
| 2010/0314890 | A1 * | 12/2010 | Hemingway | E05B 81/22 | 292/341.16 |

FOREIGN PATENT DOCUMENTS

| | | | |
|---|---|---|---|
| DE | 102004043661 | * | 3/2006 |
| DE | 102005053649 | * | 5/2007 |
| EP | 2072721 | * | 6/2009 |
| FR | 2739889 | * | 4/1997 |
| FR | 2785010 | * | 4/2000 |

* cited by examiner

CINCHING STRIKER WITH ADJUSTMENT MECHANISM

CROSS-REFERENCE TO RELATED APPLICATIONS

This applications claims priority to U.S. Provisional Patent Application No. 62/055,400 filed Sep. 25, 2014, the entire contents of which are incorporated by reference herein.

BACKGROUND

The present invention relates to latch systems, such as those used in automotive and other vehicular applications. Many latch systems for vehicular applications are used to secure doors, deck lids, lift gates, and other vehicle closures. Some vehicular latch systems may be powered to move between open and closed positions, such as latch assemblies configured to cinch from a partially latched position to a fully latched position. In some instances, a rotatable latch (commonly known as a claw, fork bolt, or ratchet) is cinched (e.g., driven to rotate by a motor) relative to a fixed striker. Also in some instances, such latch assemblies can be cinched by first engaging the latch and the striker, and then pulling the striker relative to its mounting substrate. This is referred to as a latch system with a cinching striker. Because of inherent variability in the respective substrates (e.g., sheet metal automobile panels) to which the latch and the striker are mounted, the latch and/or the striker are typically mounted to the panel substrate with an allowance for adjustment in order to obtain the desired panel-to-panel alignment (e.g., between door, deck lid, or lift gate and the corresponding vehicular body opening). To obtain the desired fit, the latch or striker may need to be mounted, evaluated, adjusted, and re-mounted.

SUMMARY

The invention provides, in one aspect, an adjustable cinching striker assembly for installation on a vehicle. The adjustable striker assembly includes a mounting frame for selectively mounting the adjustable striker assembly to the vehicle, and a striker moveably coupled to the mounting frame. A motor is coupled to the striker for moving the striker with respect to the mounting frame from an uncinched position to a cinched position, movement of the striker defining a cinching direction. The cinched position is adjustable with respect to the mounting frame.

The invention provides, in another aspect, an adjustable cinching striker assembly for installation on a vehicle. The adjustable striker assembly includes a mounting frame by which the adjustable striker assembly is mounted to the vehicle, and a striker moveably coupled to the mounting frame. A motor is coupled to the striker for moving the striker in a cinching direction between a cinched position and an uncinched position. The adjustable cinching striker assembly further includes a guide coupled to the striker and at least partially defining a path of movement of the striker between the cinched position and the uncinched position. The cinched position of the striker with respect to the vehicle is adjustable by adjusting and securing the guide in one of at least two different positions with respect to the mounting frame.

The invention provides, in another aspect, a method of adjusting a cinching striker assembly on a vehicle. The cinching striker assembly is provided with a mounting frame, a striker, and a motor operable to cinch the striker along a cinching direction relative to the mounting frame to a cinched position. The mounting frame of the cinching striker assembly is secured to the vehicle. The cinched position is adjusted along the cinching direction with respect to the mounting frame.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Figure 1:
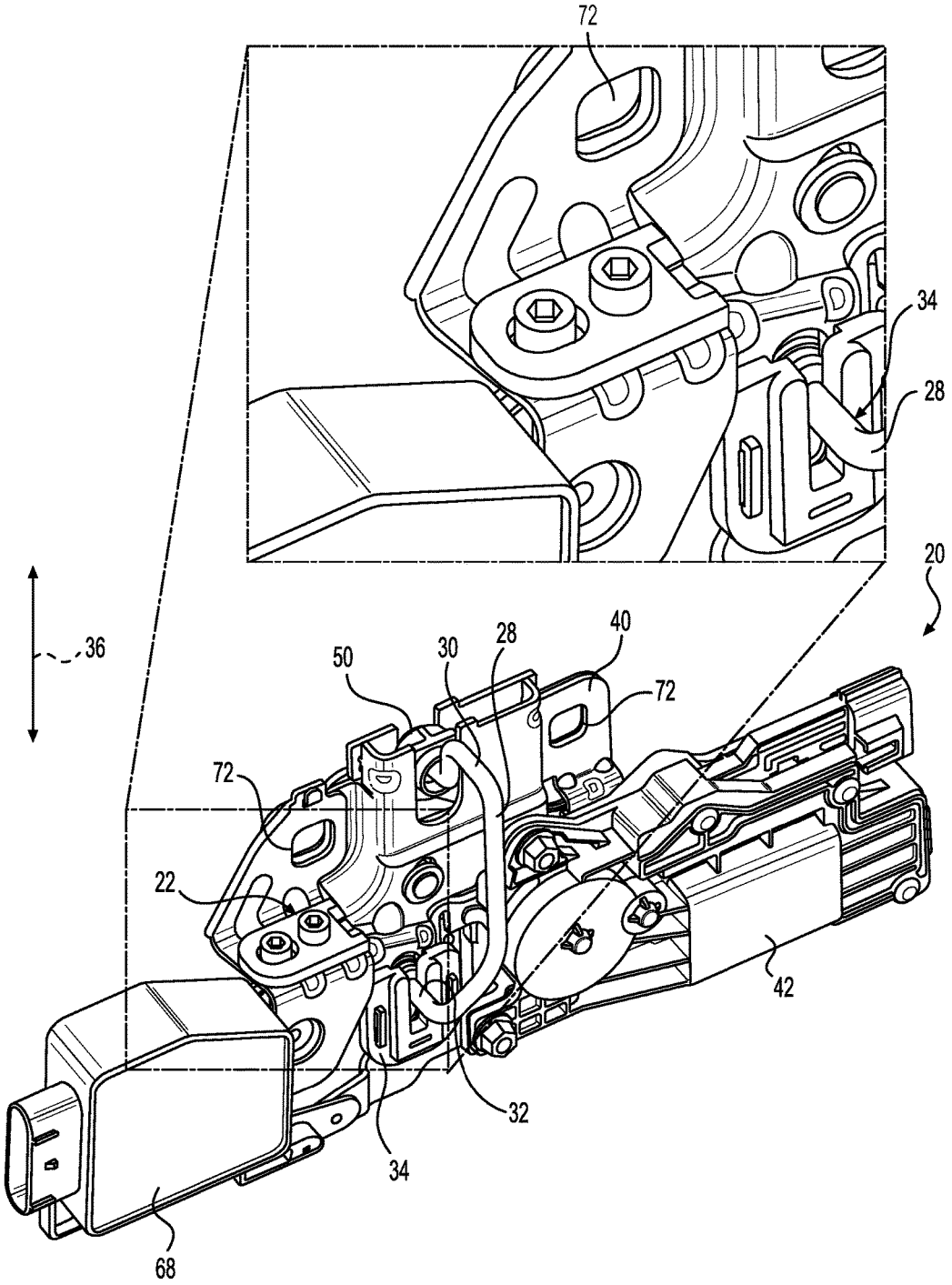
FIG. 1 is a perspective view of an adjustable cinching striker, according to one embodiment of the invention.
Figure 2:
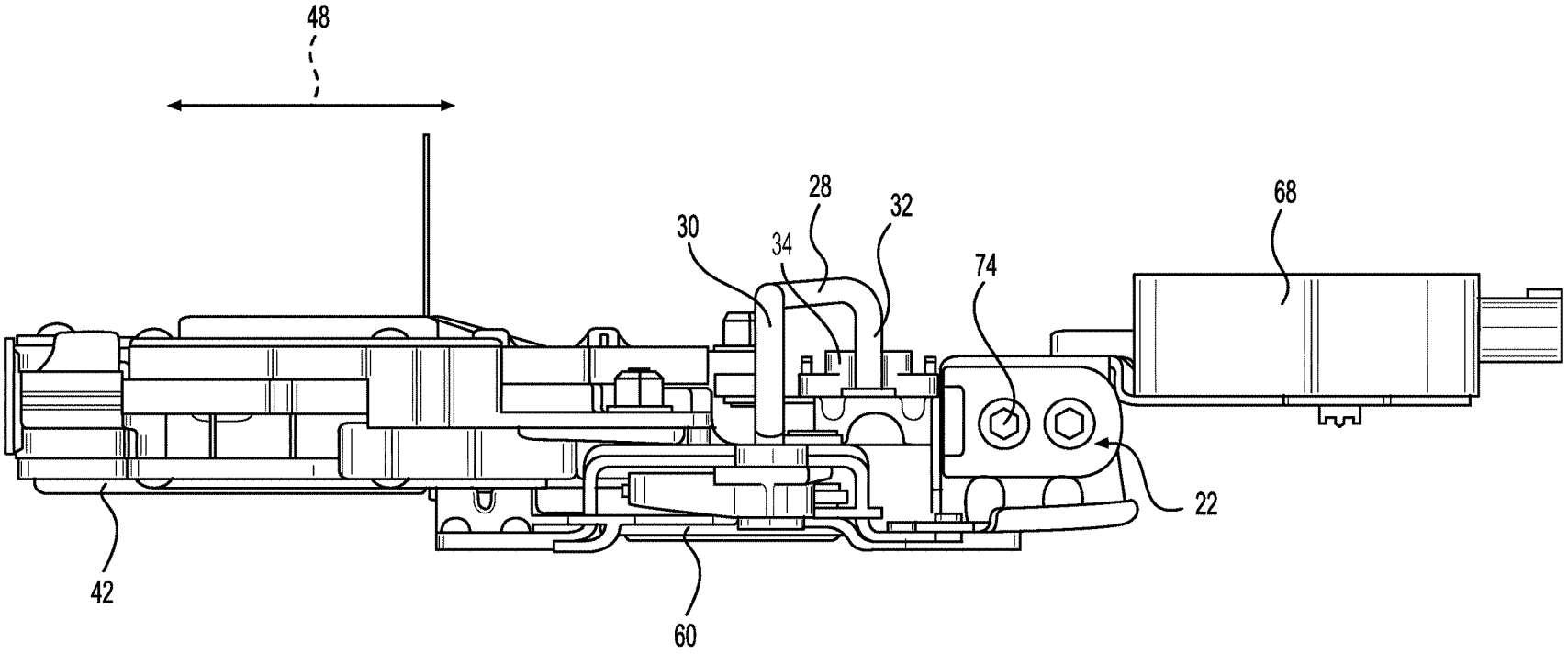
FIG. 2 is a top view of the adjustable cinching striker of FIG. 1.
Figure 11:
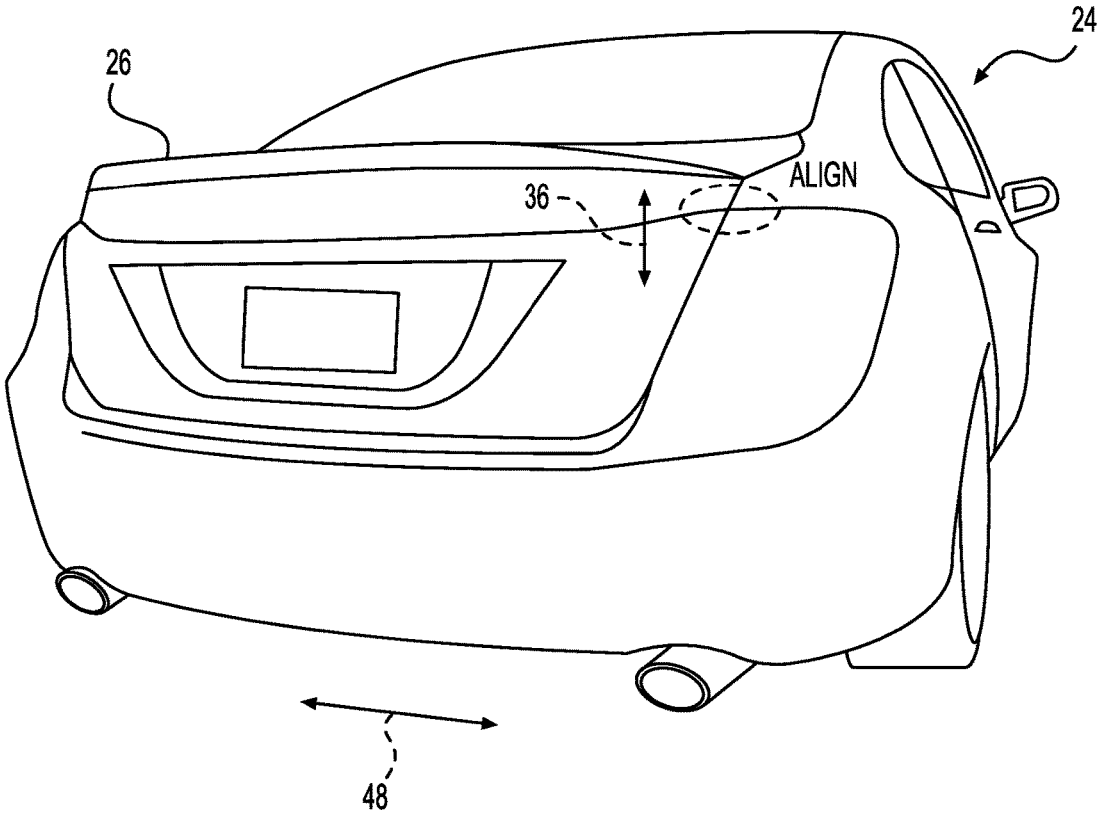
FIG. 11 is a rear perspective view of the vehicle of FIG. 10, showing the deck lid in the closed position.

FIGS. 1-3 illustrate an adjustable cinching striker according to an embodiment of the present invention. The adjustable cinching striker is a striker assembly 20 which includes an adjustment mechanism 22 according to the description provided below. The striker assembly 20 constitutes one portion of an operational latching assembly (which also includes a striker-engaging latch, not shown here) for selectively latching and releasing two components. For example, in a vehicle 24 (FIGS. 11 and 12), the latching assembly can be provided for securing/releasing a closure element 26 (e.g., a side door, sliding door, deck lid, lift gate, etc.) with respect to a corresponding body opening of the vehicle 24. In some embodiments, the striker assembly 20 can be provided adjacent the body opening of the vehicle 24, while a separate complementary latch (i.e., a rotatable claw, fork bolt, or ratchet) is provided on the closure element 26 (e.g., the door, the deck lid, the lift gate, etc.) such that when the closure element 26 swings closed, the latch engages a striker 28 of the striker assembly 20. Likewise, the latch can be driven to a released position (e.g., by connection with a manual door handle and/or a powered actuator) so that the latch releases its hold on the striker 28 for opening of the closure element 26.

As shown in FIGS. 1-3, in some embodiments the striker 28 can be formed as a bent wire, although other striker forms are possible. At an upper extent, the striker 28 includes an engagement portion 30 configured to be contacted and retained by the latch. At a lower extent, the striker 28 includes a guided portion 32, which is received by a fixed guide 34 (e.g., low friction guide channel). The striker 28 is movable in a cinching direction 36 relative to a mounting frame, such as a mounting plate 40, of the striker assembly 20 via a cinching mechanism. The cinching direction 36 is consistent with the direction of engagement by the latch. Aside from FIG. 2, the cinching direction 36 is shown in the drawings as being vertically oriented, and thus the cinching direction 36 may be referenced herein for simplicity as "vertical" Although the cinching direction 36 may be truly vertical with respect to Earth in many vehicle applications, the invention is not limited as such, as the striker assembly 20 can be oriented within the vehicle 24 in any number of different ways, including latching and cinching in a horizontal direction (e.g., a horizontal sliding door), or a direction which is skewed with respect to horizontal and/or vertical.

Figures 3A, 3B:
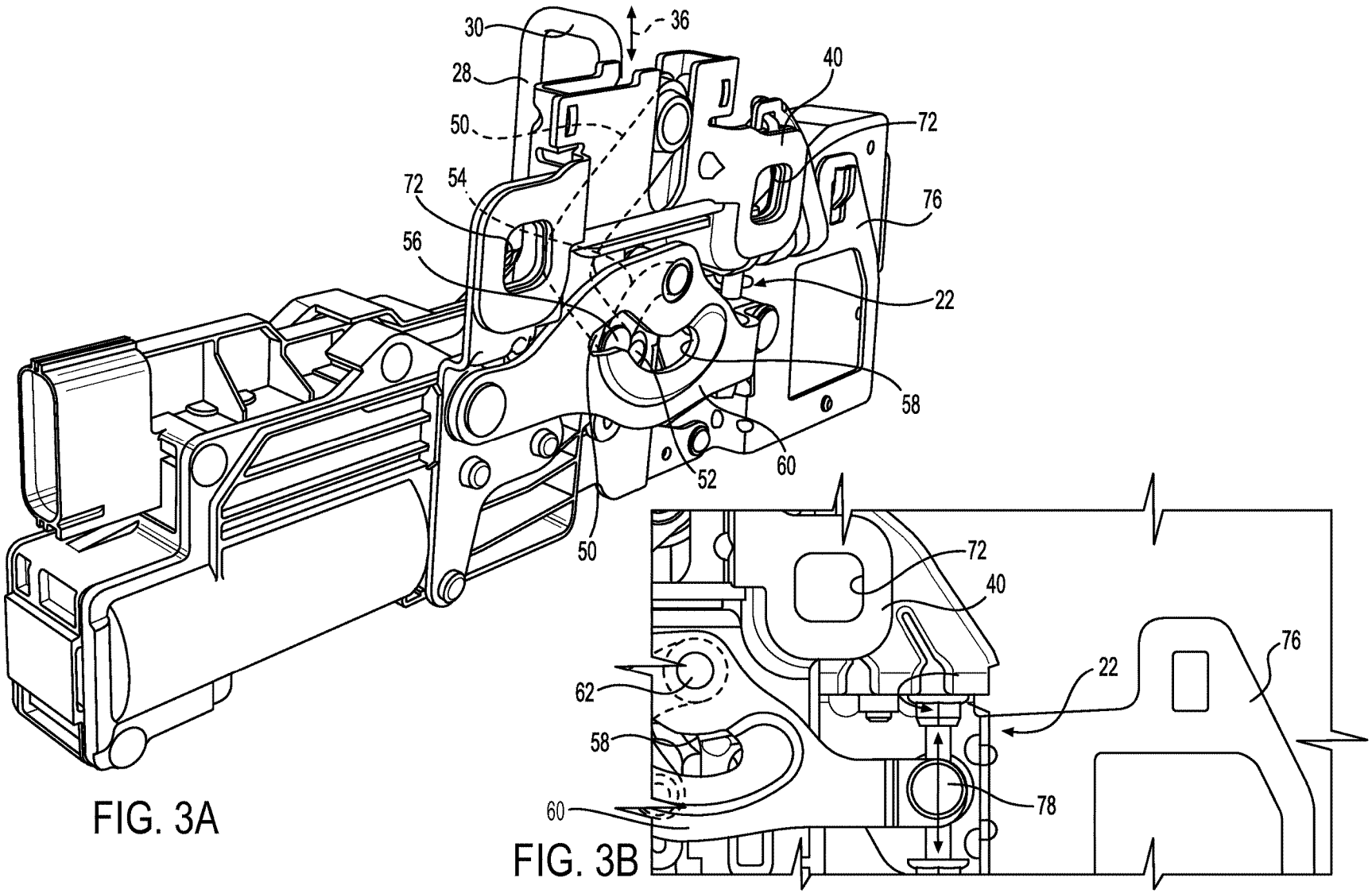
FIG. 3A is an alternate perspective view of the adjustable cinching striker of FIG. 1
FIG. 3B is an enlarged side view of FIG. 1, illustrating an adjustment screw.
Figure 4:
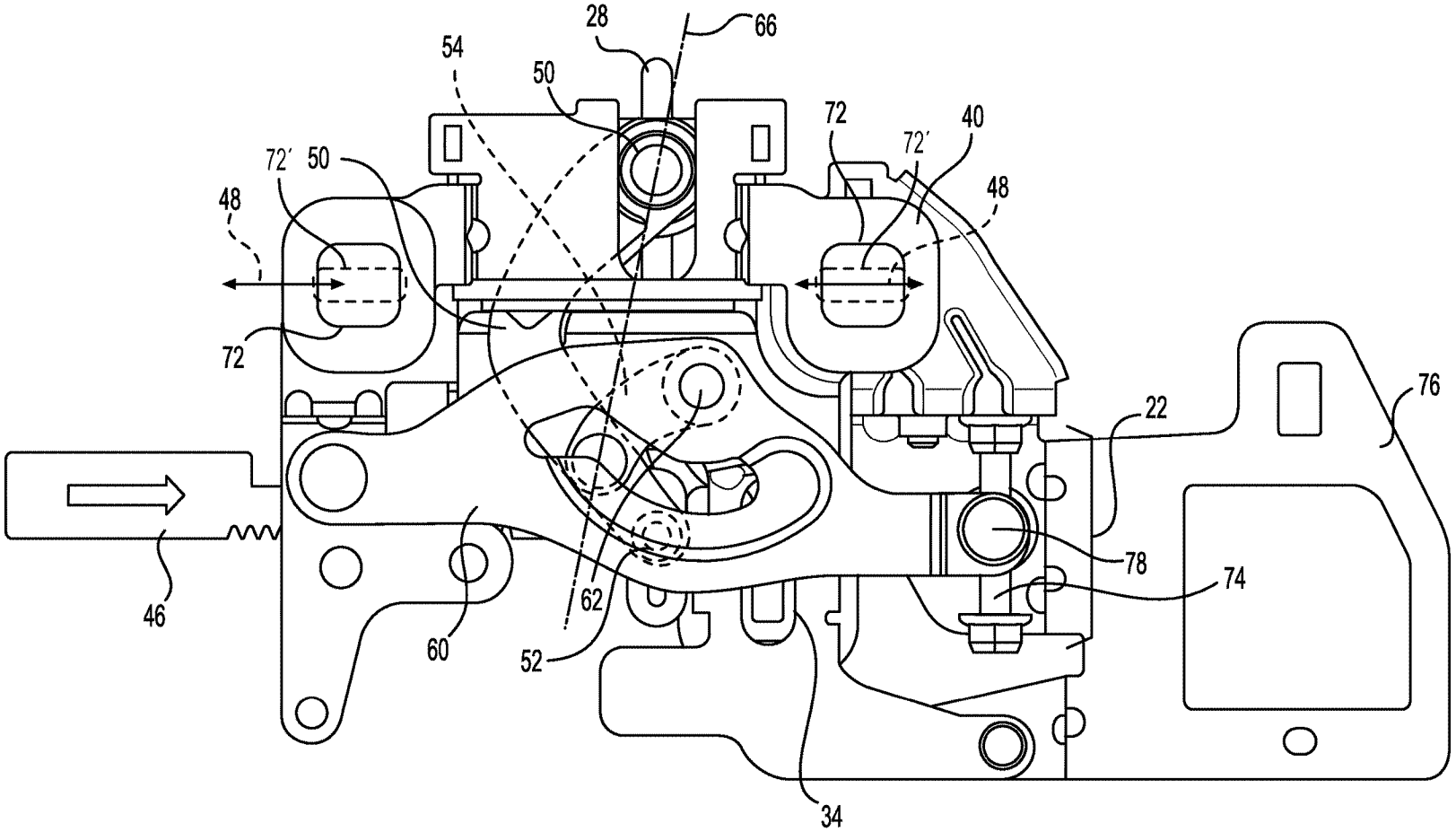
FIG. 4 is a front view of the adjustable cinching striker of FIG. 1, shown in a nominal uncinched position, exposed for contact with a movable latch component.

The striker assembly 20, and more specifically, the cinching mechanism is provided with a number of components which provide the cinching action. For example, a cinching actuator 42 is fixed to the mounting plate 40 and operable to provide a powered cinching input force to the striker 28. In some constructions, the cinching actuator 42 can include an electric motor and a linear actuator, which can include a toothed rack 46 (FIG. 4), although other actuator arrangements are possible. As shown in FIGS. 2-4, the toothed rack 46 can be driven by an output gear (not shown) to move back and forth linearly. In the illustrated construction, the movement of the toothed rack 46 is in a transverse direction 48, perpendicular to the cinching direction 36. The transverse direction 48 can be, for example, a cross-car direction 48 that is perpendicular to a longitudinal direction of vehicle travel. Such is the case in the event that the cinching mechanism is provided for cinching a deck lid latch as in FIGS. 10 and 11. The toothed rack 46 is coupled to a cinching lever 50 which is drivingly coupled to the striker 28, for example near the upper extent or the engagement portion 30 of the striker 28. The point at which the toothed rack 46 is coupled to the cinching lever 50 forms a driven point 52 (FIG. 3A) of the cinching lever 50, for example, near the lower end. Thus, the driven point 52 of the cinching lever 50 is movable generally linearly in the transverse direction 48 upon actuation by the toothed rack 46. Although the input force to the driven point 52 is linear in the illustrated embodiment, the driven point 52 on the cinching lever 50 can be coupled to the toothed rack 46 with a slotted joint to allow slight vertical movement of the driven point 52 during cinching. The cinching lever 50 is coupled to a connecting link 54 at a pivot 56. The pivot 56 includes a protuberance which is positioned within an arcuate guide slot 58 of a guide, provided as a guide link 60 in the illustrated construction. As described further below, the guide link 60 is fixed relative to the mounting plate 40, except when operating the adjustment mechanism 22. The connecting link 54 is pivotable about a pivot 62 (FIG. 3B) having a fixed position on the guide link 60 so that the pivot 56 between the cinching lever 50 and the connecting link 54 is restrained to move along an arcuate path of the arcuate guide slot 58 as the cinching lever 50 is driven by the toothed rack 46 at the driven point 52.

Figure 5:
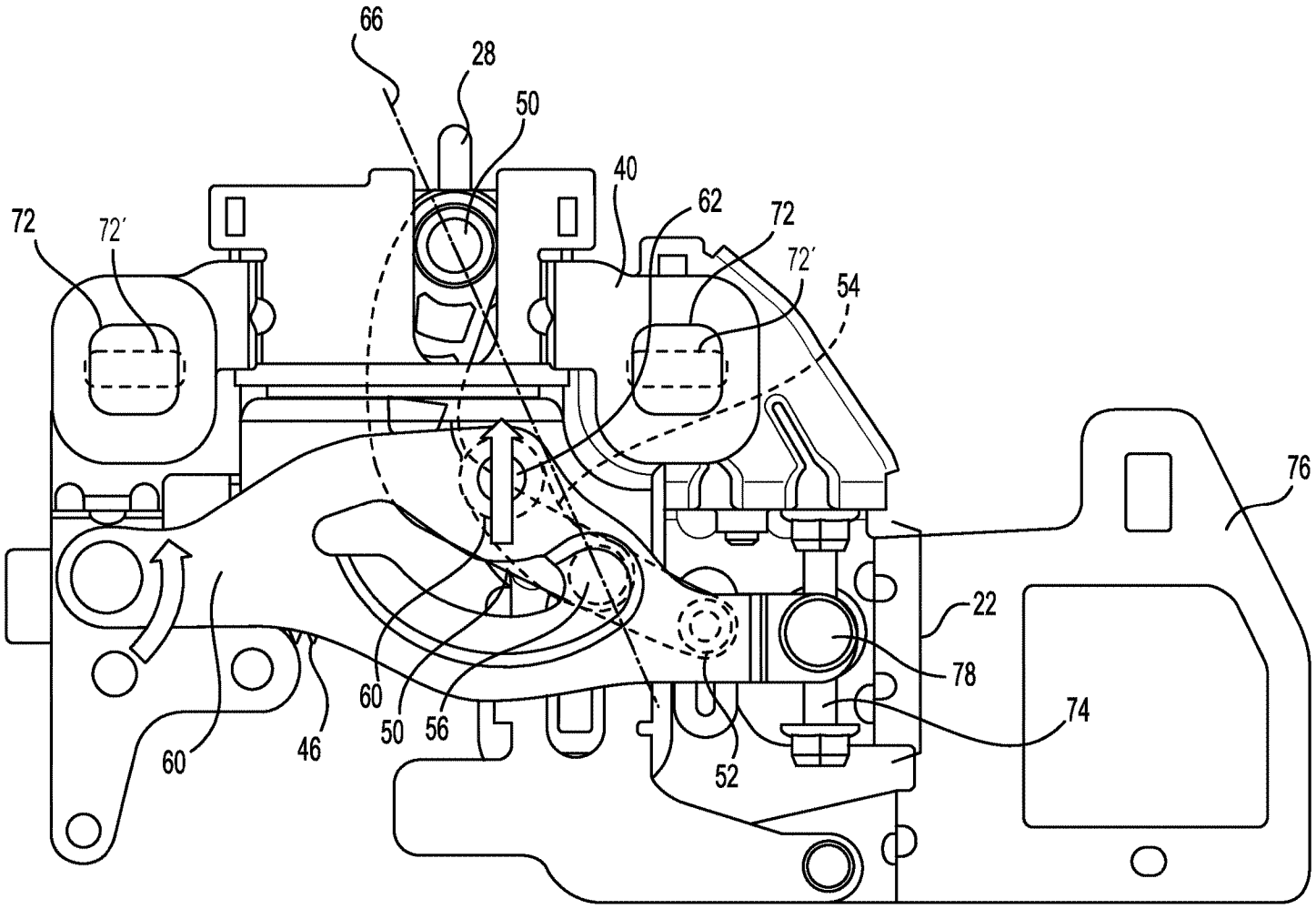
FIG. 5 is a front view of the adjustable cinching striker of FIG. 1, shown in a nominal cinched position, and with the movable latch component cinched by the striker not shown.

With reference to FIGS. 4-5, the cinching lever 50, the connecting link 54, and guide link 60 form an over-center linkage of the cinching mechanism for securing the striker 28 from an uncinched position to a cinched position. As such, the pivot 56 between the cinching lever 50 and the connecting link 54 is positioned along the cinching lever 50 between the upper end of the cinching lever 50 which defines a striker holding point 64 and the lower end of the cinching lever 50 having the driven point 52. An imaginary line 66 connecting the striker holding point 64 and the pivot 56 between the cinching lever 50 and the connecting link 54 crosses over the pivot 62 when the striker 28 is moved away from the uncinched position (FIG. 4) to the cinched position (FIG. 5). The imaginary line 66 is illustrated in FIGS. 4 and 5 by a phantom line segment. The imaginary line 66 crosses over the pivot 62 in order to reach the cinched position from the uncinched position, and the amount of crossover may vary with adjustment of the cinching mechanism relative to the mounting plate 40 via the adjustment mechanism 22 as described below.

Figure 10:
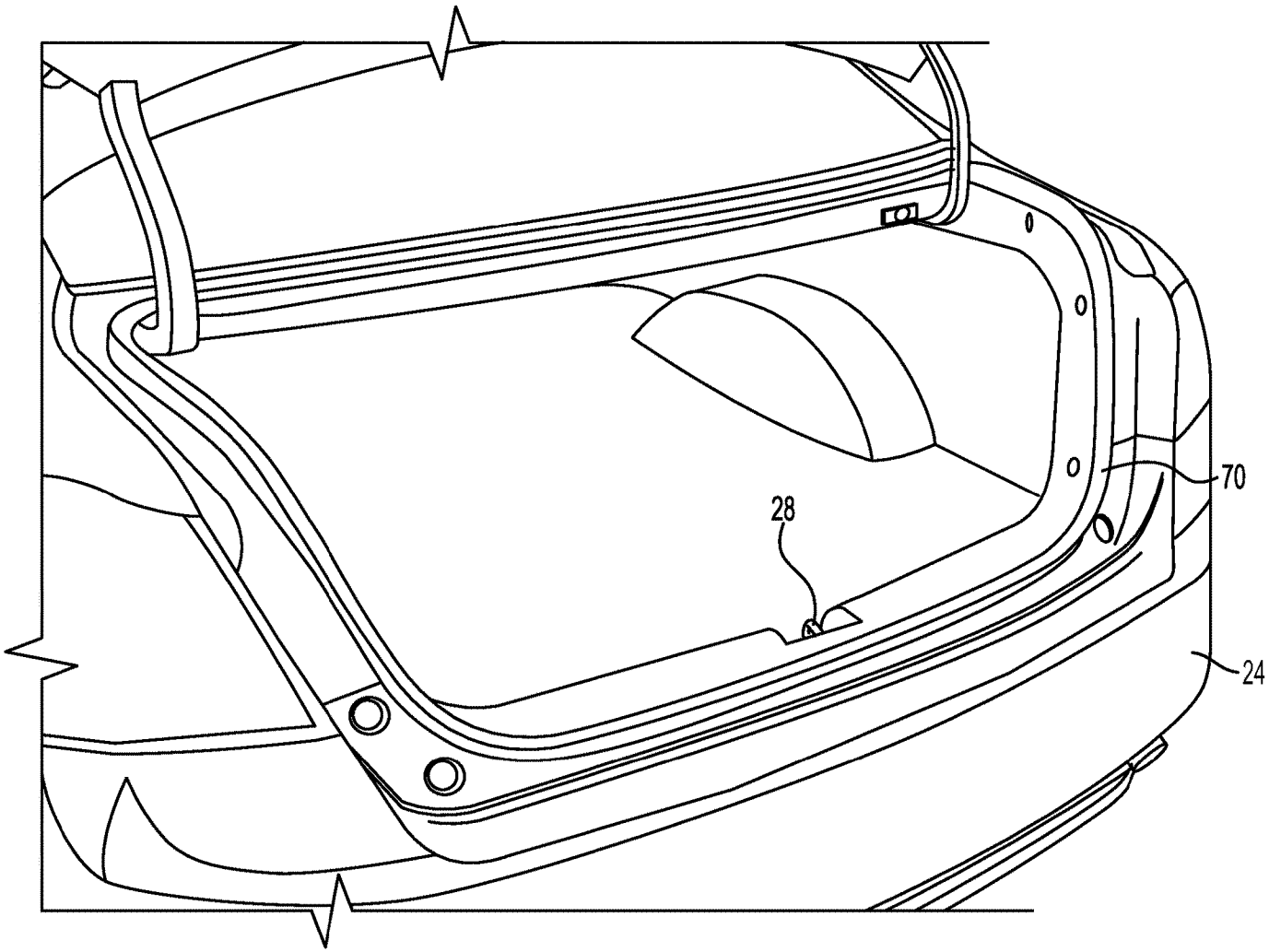
FIG. 10 is a rear perspective of a vehicle trunk, in which the adjustable cinching striker of FIG. 1 can be installed at the circled location adjacent the vehicle body opening. Although not shown, the deck lid includes a latch for selectively engaging and retaining the striker to define a latched position and for selectively releasing the striker to enable opening of the deck lid.

In operation, the cinching actuator 42 can be signaled to actuate by a control module 68 when the latch is sensed (by a suitable sensor internal or external to the control module 68) to engage the striker. From the uncinched position, the striker 28 is then actuated (i.e., cinched) vertically downward to the cinched position through the over-center linkage driven by the linear output from the cinching actuator 42. During cinching, one or more seals 70 (e.g., weather stripping, as shown in FIG. 10) encircling the interface between the vehicle 24 and the closure element 26 can be compressed. Once cinched, the over-center nature of the linkage ensures that the cinched position is retained without further input force.

The final or at-rest cinched position of the striker 28 necessarily determines the corresponding position of the complementary latch, and thus, affects the position of the closure element 26 relative to the vehicle 24. Alignment between the opening of the vehicle 24 and the edges of the closure element 26 (known as "margins") is thus affected by the position at which the striker assembly 20 is mounted relative to the vehicle 24. The striker assembly 20 can have mounting apertures 72 that are enlarged in both the cinching direction 36 and the transverse direction 48 with respect to the mounting fasteners (as shown in solid lines in FIGS. 2-9), so that the mounted position of the striker assembly 20 can be adjusted. Conventional techniques of assembly or mounting a conventional striker assembly to the vehicle 24 is accomplished by checking the margins, and at least partial un-mounting of the conventional striker assembly in order to adjust the alignment. Thus, this type of conventional striker assembly is not in itself adjustable to provide for different striker settings—it can only be moved as a whole relative to the vehicle 24. This also presents the problem that, when loosening the mounting plate from the vehicle 24, it can be difficult to adjust the conventional striker assembly in only one direction while trying to maintain the other (i.e., the typical striker assembly has one universal point of adjustment, rather than independent points of adjustment for the cinching direction 36 and the transverse direction 48).

Although mounting apertures 72 that are enlarged or elongated in both the cinching direction 36 and the transverse direction 48 can be provided in the mounting plate 40 of the striker assembly 20, the mounting apertures 72 need not be provided as such. For example, mounting apertures 72' elongated only in a direction perpendicular to the cinching direction 36 (e.g., elongated in the transverse direction 48) can be provided. Separate adjustability of the striker 28 in the cinching direction 36 relative to the mounting plate 40 is provided by the adjustment mechanism 22. The adjustment mechanism 22 is interposed between the striker 28 and the mounting plate 40 and operable to adjust the position of the guide link 60 (including the guide slot 58 and the pivot 62 of the connecting link 54) relative to the mounting plate 40. In doing so, the traveling distance or the "cinching range" of the striker 28 between the cinched and uncinched positions may or may not be altered by the adjustment mechanism 22. Accordingly, at least the final cinched position of the striker 28 can be adjusted independently of the position of the mounting plate relative to the vehicle 24 for accurate, efficient correction of the margins after the striker assembly 20 is securely mounted to the vehicle 24.

In some embodiments, the adjustment mechanism 22 includes a lead screw 74 configured to be rotated in place with respect to the mounting plate 40, as shown in FIG. 3B. The lead screw 74 can be supported directly by the mounting plate 40, or as shown, by a separate support whose position is fixed relative to the mounting plate 40. As illustrated, the lead screw 74 is supported by a bracket 76 which also supports the control module 68. Although the striker assembly 20 is shown with the control module 68 integrated, the control module 68 can be separately provided. Again with reference to the illustrated embodiment, the lead screw 74 is threaded with a nut 78 which is secured to the guide link 60 (e.g., to an end of the guide link 60, as shown), such that this end of the guide link 60 is adjustable via rotation of the lead screw 74. The nut 78 acts as a follower that moves as shown in response to rotation of the lead screw 74. As such, the adjustment mechanism provides infinite adjustability of the striker's cinched position within a range of adjustment. Another portion of the guide link 60 (e.g., the end of the guide link 60 opposite the nut 78 in the illustrated embodiment) can be coupled to the mounting plate 40, or otherwise secured relative to the mounting plate 40, without adjustability.

Operation of the illustrated adjustment mechanism 22 alters the position of the pivot 62 in the cinching direction 36 with respect to the mounting plate 40, along with the guide slot 58 such that the cinched and uncinched positions of the striker 28 are adjusted accordingly. In particular, this allows fine tuning of the cinched position of the striker 28 relative to the mounting plate 40 along the cinching direction 36. Once the desired cinched position of the striker 28 is set via the adjustment mechanism 22, the adjustment mechanism 22 can be put into a de-activated state (e.g., the lead screw 74 can be locked against rotation relative to the mounting plate 40). The lead screw 74 can be locked against rotation by tightening of an additional fastener (e.g., screw) to compress the lead screw 74 with a lock plate. In another embodiment, a lock nut may be provided to selectively prevent rotation of the lead screw 74 to lock out the adjustment mechanism 22 from further providing unintended adjustment of the striker's cinched position. In such cases, a single tool may be provided to hold the lead screw 74 stationary in the final adjustment position during tightening of the lock nut.

Figure 6:
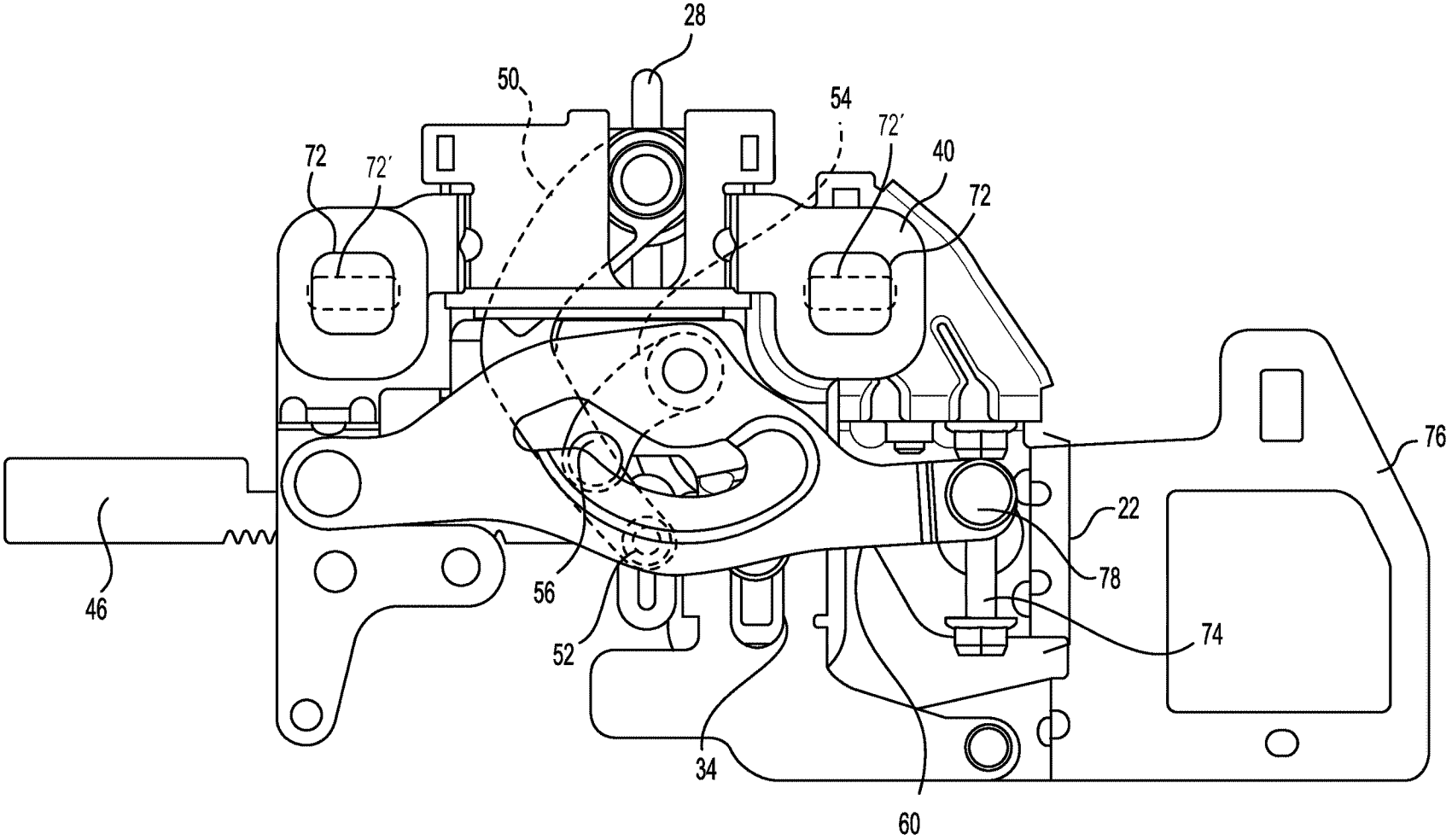
FIG. 6 is a front view of the adjustable cinching striker of FIG. 1, shown in an upwardly adjusted uncinched position.
Figure 7:
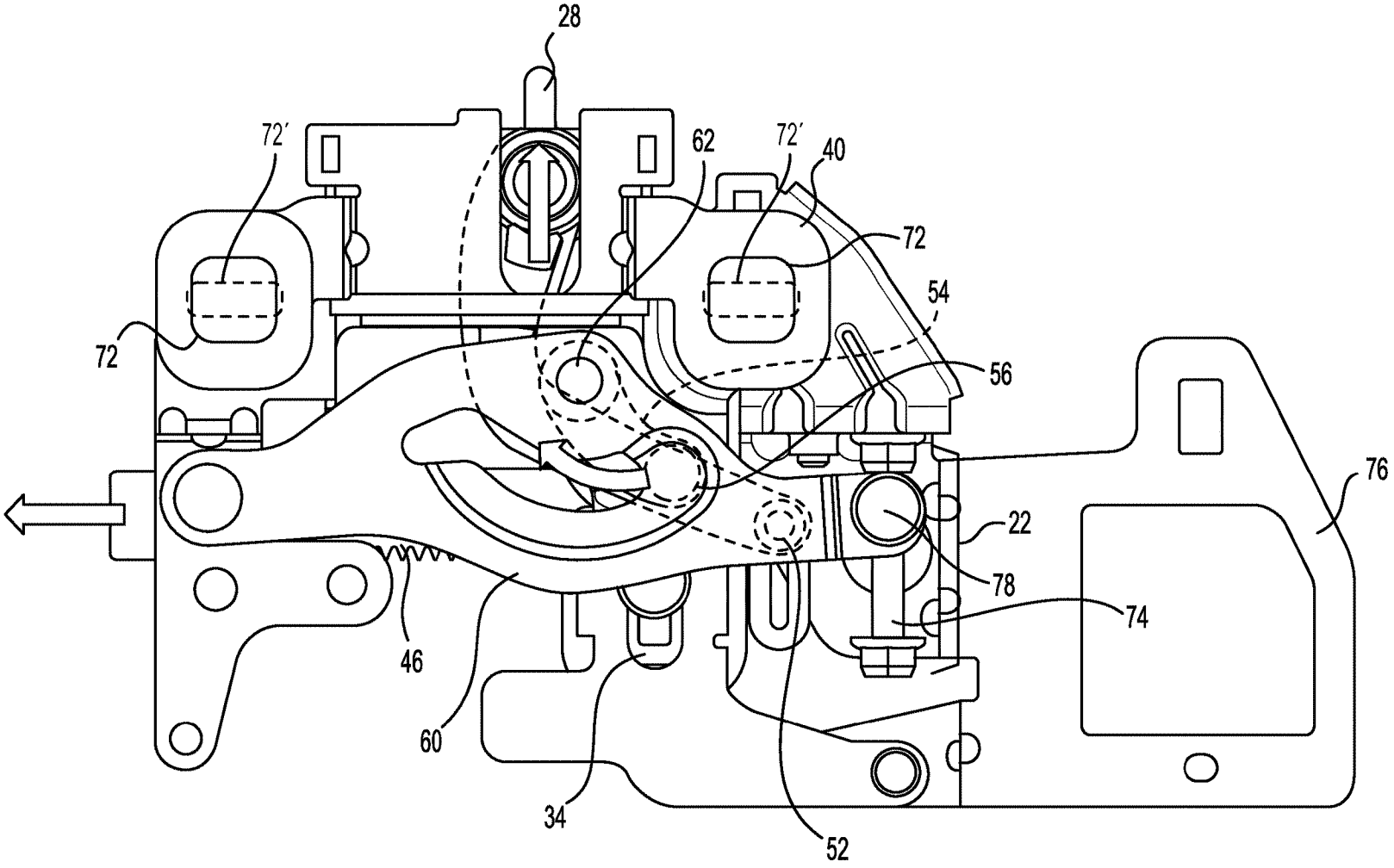
FIG. 7 is a front view of the adjustable cinching striker of FIG. 1, with the upward adjustment of FIG. 6, and shown in the cinched position.
Figure 8:
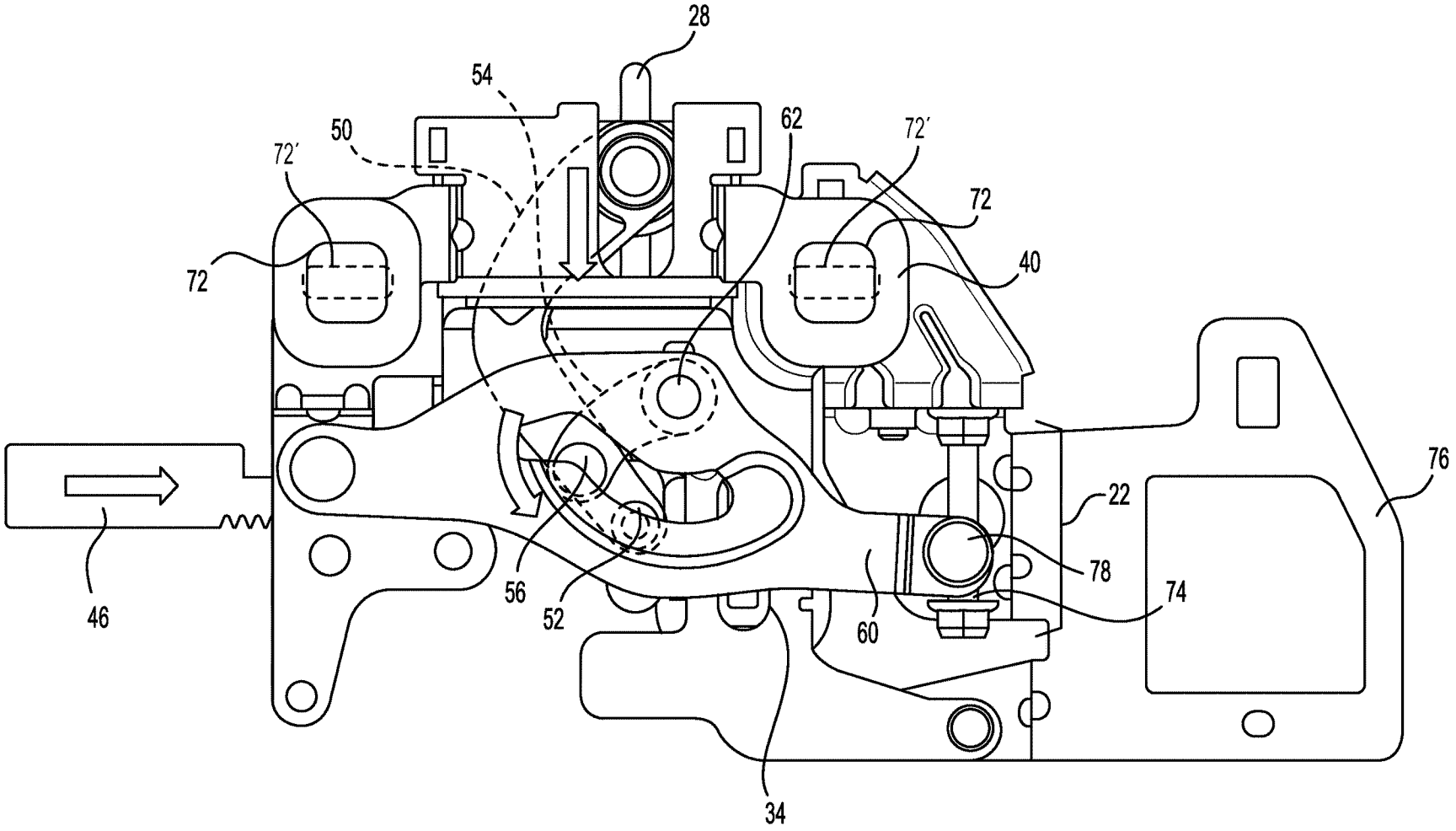
FIG. 8 is a front view of the adjustable cinching striker of FIG. 1, shown in a downwardly adjusted uncinched position.
Figure 9:
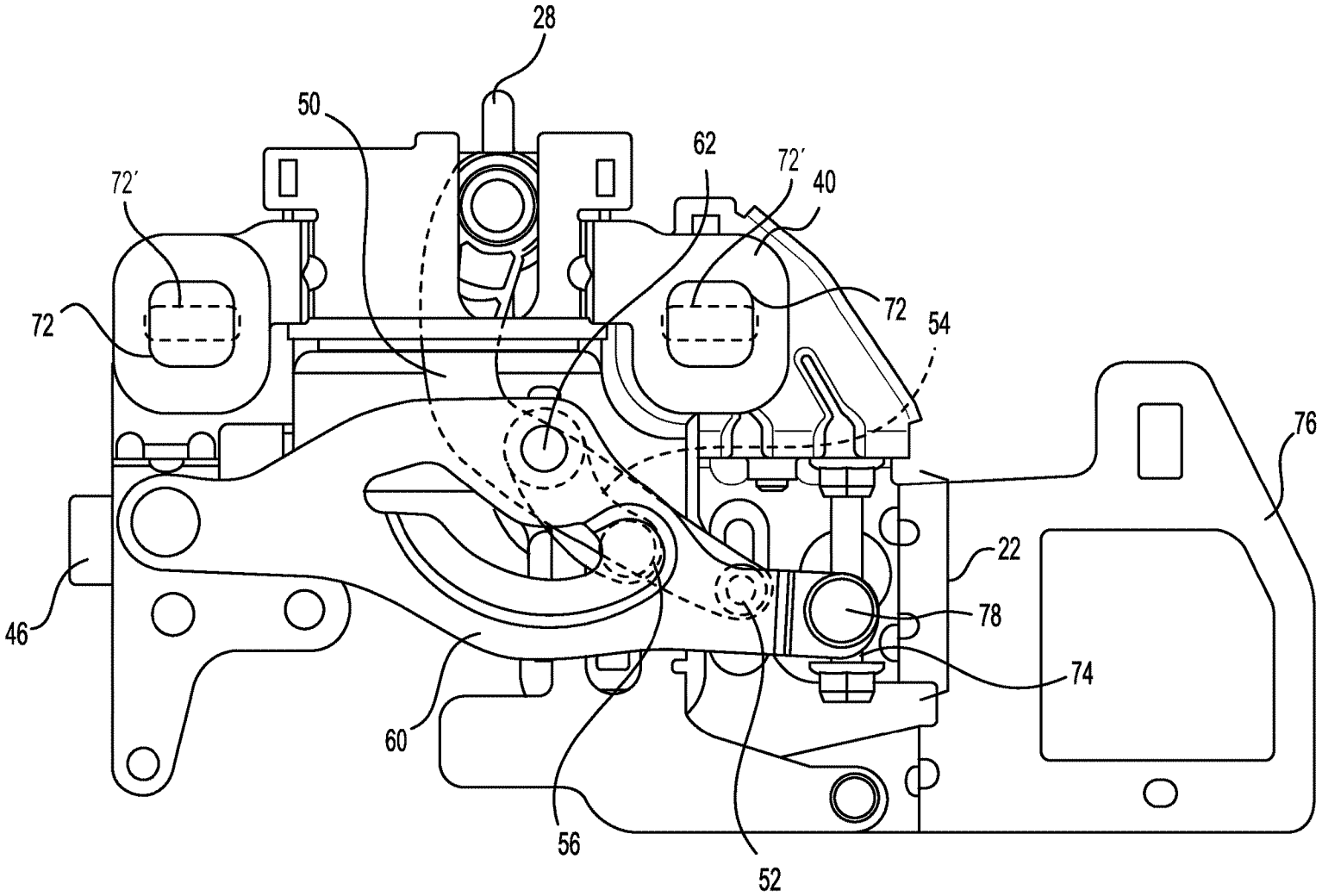
FIG. 9 is a front view of the adjustable cinching striker of FIG. 1, with the downward adjustment of FIG. 8, and shown in the cinched position.

FIGS. 4 and 5 illustrate the striker assembly 20 in a nominal or central setting of the striker height. FIG. 5 illustrates the striker 28 moved to the cinched position from the uncinched position of FIG. 4. FIGS. 6 and 7 illustrate the striker assembly 20 adjusted to an increased height setting of the striker 28. FIG. 7 illustrates the striker 28 moved to the cinched position from the uncinched position of FIG. 6. FIGS. 8 and 9 illustrate the striker assembly 20 adjusted to a lowered height setting of the striker 28. FIG. 9 illustrates the striker 28 moved to the cinched position from the uncinched position of FIG. 8.

The striker assembly 20 can be manufactured and assembled (prior to assembly with the vehicle 24) in any desired state of adjustment, and may be tailored to the needs of a particular application or vehicle assembly process. For example, the height setting of the striker 28 can be pre-set to a nominal position mid-way between the upward and downward extents of allowable adjustment to allow equal adjustability in either direction. Alternately, the height setting of the striker 28 can be pre-set at or near either the upward or downward extent in cases where the necessary final adjustment on the vehicle 24 is ensured to be in a particular direction due to other assembly tolerances or procedures. As such, determination of adjustment direction is eliminated, and only an amount of adjustment needs to be determined.

The design of the striker assembly 20, as shown in FIGS. 1-9, improves adjustability in the cinching direction 36 of the striker 28, independent of the position in the transverse direction 48 (e.g., the cross-car setting). In some embodiments, the setting in the transverse direction 48 can be set during initial placement of the striker assembly 20 to the vehicle 24, with the adjustment mechanism 22 enabling adjustment in the cinching direction 36 to be made with the striker 28 mounted in the vehicle 24 without disturbing the transverse setting, and without disturbing the fixed relationship between the mounting plate 40 and the vehicle 24. Vertical adjustment in the cinching direction 36 can be done with simple access through a striker hole trap door or other access point. In some aspects of the invention, vertical adjustment of the striker 28 is enabled while maintaining initial mounting positions/points. In other words, the mounting plate 40 need not be loosened from the vehicle 24 to vertically adjust the striker 28 relative to the vehicle 24. The adjustment mechanism 22 does not adversely affect the function or strength of the cinching mechanism. Also, the striker 28 allows for improved fitting of the vehicle margins without the need to loosen or bend the striker 28 (i.e., the wire forming the striker itself) or the striker mechanism 22 as a whole. Thus, the vertical position of the striker 28 can be independently adjustable relative to the mounting plate 40.

Although not shown, in some embodiment the striker assembly 20 may simply include the cinching actuator 42 coupled directly to the striker 28, such that linkages 50, 54, 60 are not provided. In this case, the cinching actuator 42 may be controlled by the control module 68 for moving the striker 28 between the uncinched position and cinched position, and adjusting the nominal position of the striker 28 relative to the mounting plate 40. Thus, the uncinched position, the cinched position, and the nominal position of the striker 28 may be programmed (or optionally altered) into the control module 68 via an external computing device. In this case, the cinching range can be additionally altered via the external computing device.

It should be understood that one of ordinary skill in the art will appreciate certain modifications to the particular structures or operations described and shown in the present application, which modifications are clearly within the spirit and scope of the invention as disclosed herein. For example, in some constructions, the striker assembly can be mounted to a door, deck lid, lift gate, or other vehicle closure while the complementary latch is provided on the vehicle body. The exact arrangement, structure, and sizing of certain components of the striker assembly are also subject to variation to meet a variety of applications.

What is claimed is:

1. An adjustable cinching striker assembly for installation on a vehicle, the adjustable striker assembly comprising:

a mounting frame for selectively mounting the adjustable striker assembly to the vehicle;

a striker moveably coupled to the mounting frame;

a motor coupled to the striker for driving a cinching of the striker with respect to the mounting frame from an uncinched position to a cinched position along a cinching direction; and a link coupled to the mounting frame and operable to guide movement of a cinching mechanism between the motor and the striker, wherein the link is adjustable relative to the mounting frame by an adjustment mechanism, wherein the adjustment mechanism includes a lead screw, and the link is provided with a nut engaged with the lead screw as a follower such that the position of the link is adjusted in response to rotation of the lead screw, and wherein the cinched position of the striker is independently adjustable with respect to the mounting frame separately from and without cinching the striker between the uncinched position and the cinched position.

2. The adjustable cinching striker assembly of claim 1, wherein the lead screw is rotatable in a first direction to adjust the cinched position of the striker in a first direction, and is rotatable in a second direction to adjust the cinched position of the striker in a second direction opposite the first direction.

3. The adjustable cinching striker assembly of claim 1, further comprising a lock plate engageable with the lead screw to fix a rotational position of the lead screw with respect to the mounting frame.

4. The adjustable cinching striker assembly of claim 1, wherein the adjustment mechanism provides infinite adjustability within a range of adjustment.

5. The adjustable cinching striker assembly of claim 1, wherein the cinched position of the striker is adjustable along the cinching direction, without altering the position of the striker in a transverse direction perpendicular to the cinching direction.

6. The adjustable cinching striker assembly of claim 1, wherein the mounting frame includes a set of mounting apertures operable to receive respective fasteners to secure the mounting frame to the vehicle, and wherein each of the set of mounting apertures is elongated in a transverse direction perpendicular to the cinching direction.

7. The adjustable cinching striker assembly of claim 1, wherein the mounting frame constrains movement of the striker to movements along the cinching direction between the cinched and uncinched positions.

8. The adjustable cinching striker assembly of claim 1, further comprising a control module connected to the motor to control the movement of the striker between the uncinched and cinched positions.

9. An adjustable cinching striker assembly for installation on a vehicle, the adjustable striker assembly comprising:

a mounting frame for selectively mounting the adjustable striker assembly to the vehicle;

a striker moveably coupled to the mounting frame;

a motor coupled to the striker for moving the striker in a cinching direction between a cinched position and an uncinched position;

a guide coupled to the striker and at least partially defining a path of movement of the striker between the cinched position and the uncinched position; and an adjustment mechanism interposed between the striker and the mounting frame for adjusting the position of the guide relative to the mounting frame, wherein the adjustment mechanism includes a lead screw, and the guide is provided with a nut engaged with the lead screw as a follower such that the position of the guide is adjusted in response to rotation of the lead screw, and wherein the cinched position of the striker with respect to the vehicle is adjustable by adjusting and securing the guide in one of at least two different positions with respect to the mounting frame.

10. The adjustable cinching striker assembly of claim 9, wherein the lead screw is rotatable in a first direction to adjust the cinched position of the striker in a first direction, and is rotatable in a second direction to adjust the cinched position of the striker in a second direction opposite the first direction.

11. The adjustable cinching striker assembly of claim 9, further comprising a lock plate engageable with the lead screw to fix a rotational position of the lead screw with respect to the mounting frame.

12. The adjustable cinching striker assembly of claim 9, wherein the adjustment mechanism provides infinite adjustability within a range of adjustment.

13. The adjustable cinching striker assembly of claim 9, wherein the mounting frame includes a set of mounting apertures operable to receive respective fasteners to secure the mounting frame to the vehicle, and wherein each of the set of mounting apertures is elongated in a transverse direction perpendicular to the cinching direction.

14. The adjustable cinching striker assembly of claim 9, further comprising a control module connected to the motor to control the movement of the striker.

15. A method of adjusting a cinching striker assembly on a vehicle, the method comprising:

providing the cinching striker assembly with a mounting frame, a striker, and a motor operable to cinch the striker along a cinching direction relative to the mounting frame to a cinched position;

providing the cinching striker assembly with a guide coupled to the striker and at least partially defining a path of movement of the striker between the cinched position and the uncinched position;

providing the cinching striker assembly with an adjustment mechanism interposed between the striker and the mounting frame for adjusting the position of the guide relative to the mounting frame;

securing the mounting frame of the cinching striker assembly to the vehicle; and adjusting the cinched position along the cinching direction with respect to the mounting frame separately from and without cinching the striker to the cinched position, wherein adjusting the cinched position includes rotating a lead screw of the adjustment mechanism so that a nut provided on the guide acts as a follower and the position of the guide is adjusted.

16. The method of claim 15, wherein the cinching striker assembly is provided as part of a latching assembly between a vehicle closure element and a corresponding vehicle body opening, the method further comprising operating the motor to cinch the striker to the cinched position and evaluating the margins between the vehicle closure element and the vehicle body opening prior to adjusting the cinched position.

* * * * *